US007523727B2

(12) United States Patent
Fujii et al.

(10) Patent No.: US 7,523,727 B2
(45) Date of Patent: Apr. 28, 2009

(54) ENGINE

(75) Inventors: Noriaki Fujii, Saitama (JP); Katsunori Nakamura, Saitama (JP); Akiyuki Yonekawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/586,643

(22) PCT Filed: Jan. 28, 2005

(86) PCT No.: PCT/JP2005/001194

§ 371 (c)(1),
(2), (4) Date: Jun. 13, 2007

(87) PCT Pub. No.: WO2005/073523

PCT Pub. Date: Aug. 11, 2005

(65) Prior Publication Data

US 2007/0245986 A1 Oct. 25, 2007

(30) Foreign Application Priority Data

Jan. 30, 2004 (JP) ..... 2004-023951
Dec. 3, 2004 (JP) ..... 2004-350754

(51) Int. Cl.
*F01L 1/34* (2006.01)

(52) U.S. Cl. ..... 123/90.17; 123/90.15; 123/90.31

(58) Field of Classification Search ... 123/90.15–90.17, 123/90.31
See application file for complete search history.

(56) References Cited

U.S. PATENT DOCUMENTS 5,373,818 A 12/1994 Unger ..... 123/90.16
6,354,255 B1 * 3/2002 Methley et al. ..... 123/90.16
6,425,357 B2 * 7/2002 Shimizu et al. ..... 123/90.16

FOREIGN PATENT DOCUMENTS

| | | |
|---|---|---|
| DE | 42 23 172 | 8/1993 |
| DE | 43 26 331 | 2/1995 |
| EP | 1 111 206 | 6/2001 |

(Continued)

OTHER PUBLICATIONS

Supplementary European Search Report mailed Nov. 7, 2008 in a corresponding application, 4 pages.

*Primary Examiner*—Zelalem Eshete
(74) *Attorney, Agent, or Firm*—Kratz, Quintos & Hanson, LLP

(57) ABSTRACT

In an engine having a cylinder head which forms a portion of an engine body and is provided with an intake valve operated for opening and closing operations by an intake valve operating device having an intake camshaft and an exhaust valve driven for opening and closing operations by an exhaust valve operating device having an exhaust camshaft, the intake camshaft (30) is placed higher in position than the exhaust camshaft (35) by increasing the distance between the intake camshaft (30) and a combustion chamber (17) along a cylinder axis (C) of the engine body (11) relative to that between the exhaust camshaft (35) and the combustion chamber (17). Lubricating oil is thereby enabled to be easily used for exhaust valve operating device after being used for lubrication and cooling of the intake valve operating device, thus achieving efficient lubrication and cooling of the exhaust valve operating device.

3 Claims, 10 Drawing Sheets

FOREIGN PATENT DOCUMENTS

| | | |
|---|---|---|
| EP | 1 548 240 | 6/2005 |
| EP | 1 628 007 | 2/2006 |
| EP | 1 707 765 | 10/2006 |
| EP | 1 707 766 | 10/2006 |
| EP | 1 707 767 | 10/2006 |
| EP | 1 707 768 | 10/2006 |
| EP | 1 707 770 | 10/2006 |
| GB | 2 298 899 | 9/1996 |
| JP | 5-39707 | 2/1993 |
| JP | 11-107855 | 4/1999 |
| JP | 11-350923 | 12/1999 |
| JP | 2003-343228 | 12/2003 |
| JP | 2004-36560 | 2/2004 |
| JP | 2004-52708 | 2/2004 |
| JP | 2004-353599 | 12/2004 |

* cited by examiner

ENGINE

TECHNICAL FIELD

The present invention relates to an engine in which an intake valve driven for opening and closing operations by an intake valve operating device having an intake camshaft and an exhaust valve driven for opening and closing operations by an exhaust valve operating device having an exhaust camshaft are provided in a cylinder head forming a portion of an engine body.

BACKGROUND ART

Such engine is known from Patent Document 1, for example. Patent Document 1:

Japanese Patent Application Laid-open No. 2004-52708.

DISCLOSURE OF THE INVENTION

Problem to be Solved by the Invention

Lubrication and cooling of an exhaust valve operating device must be performed under thermally severe conditions in comparison with lubrication and cooling of an intake valve operating device. If lubricating oil can be used for an exhaust valve operating device after being used for lubrication and cooling of an intake valve operating device at a comparatively low temperature, lubrication and cooling of the exhaust valve operating device can be efficiently performed. In the engine disclosed in the above-described Japanese Patent Application Laid-open No. 2004-52708, however, the intake camshaft of the intake valve operating device and the exhaust camshaft of the exhaust valve operating device are placed at the same position in the direction along the cylinder axis of the engine body and, therefore, it is difficult to use lubricating oil for lubrication and cooling of the exhaust valve operating device after use for lubrication of the intake camshaft.

In view of the above-described circumstances, an object of the present invention is to provide an engine in which lubricating oil can be easily used for an exhaust valve operating device after being used for lubrication and cooling of an intake valve operating device to enable lubrication and cooling of the exhaust valve operating device with efficiency.

Means for Solving the Problem

To achieve the above-described object, according to a first feature of the present invention, there is provided an engine having a cylinder head which forms a portion of an engine body and is provided with an intake valve driven for opening and closing operations by an intake valve operating device having an intake camshaft and an exhaust valve driven for opening and closing operations by an intake valve operating device having an exhaust camshaft, characterized in that the intake camshaft is placed higher in position than the exhaust camshaft by increasing the distance between the intake camshaft and a combustion chamber along a cylinder axis of the engine body relative to the distance between the exhaust camshaft and the combustion chamber.

According to a second feature of the present invention in addition to the arrangement of the first feature, there is provided an engine, wherein the intake valve operating device has a variable lift mechanism capable of changing the valve opening lift amount of the intake valve, and the exhaust valve operating device has the exhaust camshaft and an exhaust rocker arm linked and connected to the exhaust valve so as to swing by following the exhaust camshaft.

According to a third feature of the present invention in addition to the arrangement of the first feature, there is provided an engine, wherein the engine body is placed in an attitude such that the cylinder axis is inclined toward the exhaust valve operating device.

According to a fourth feature of the present invention in addition to the arrangement of the first feature, there is provided an engine, wherein the direction of rotation of the intake camshaft is set so that the intake camshaft rotates by moving upward on the side where the intake camshaft faces the exhaust valve operating device.

According to a fifth feature of the present invention in addition to the arrangement of the second feature, there is provided an engine, wherein the intake valve operating device includes the intake camshaft having an intake valve operating cam, an intake rocker arm having a cam contact portion which contacts the intake valve operating cam, the intake rocker arm being liked and connected to the intake valve so as to apply a force to the intake valve in the valve opening direction, and the variable lift mechanism, and the variable lift mechanism has a first link arm having one end thereof turnably connected to the intake rocker arm and the other end turnably supported at a fixed position on the engine body through a fixed supporting shaft, and a second link arm having one end thereof turnably connected to the intake rocker arm and the other end turnably supported on a movable supporting shaft capable of being displaced.

According to a sixth feature of the present invention in addition to the arrangement according to the fifth feature, there is provided an engine, wherein the fixed supporting shaft and the movable supporting shaft are placed inside a portion for linkage and connection of the intake rocker arm to the intake valve, and a portion of the exhaust valve operating device for swingably supporting the exhaust rocker arm is placed outside a portion for linkage and connection of the exhaust rocker arm and the exhaust valve.

According to a seventh feature of the present invention in addition to the arrangement according to the sixth feature, there is provided an engine, wherein a plug cylinder inclined so as to be brought closer to the exhaust valve operating device at a position closer to an upper end thereof is mounted in the cylinder head by being placed between the intake valve operating device and the exhaust valve operating device.

Effect of the Invention

According to the first feature of the present invention, the intake camshaft is higher in position than the exhaust camshaft. Therefore, lubricating oil can be easily caused to flow to the exhaust valve operating device after lubricating and cooling the intake valve operating device at a comparatively low temperature, thus achieving efficient lubrication and cooling of the exhaust valve operating device under thermally severe conditions.

According to the second feature of the present invention, the lift of the intake valve is changed by the variable lift mechanism, thus enabling control of the amount of air intake without using the throttle valve. Moreover, the variable lift mechanism can be effectively arranged in a space on the intake valve operating device side where there is room larger than that on the exhaust valve operating device side.

According to the third feature of the present invention, the cylinder axis of the engine body is inclined toward the exhaust valve operating device, so that lubricating oil flows more smoothly to the exhaust valve operating device after lubricating and cooling the intake valve operating device, thus achieving more efficient lubrication and cooling of the exhaust valve operating device.

According to the fourth feature of the present invention, an upward splash of the lubricating oil toward the exhaust valve operating device is caused by the rotation of the intake camshaft to more efficiently lubricate and cool the exhaust valve operating device.

According to the fifth feature of the present invention, ends of the first and second link arms forming the variable lift mechanism are turnably connected directly to the rocker arm, so that the space in which the two link arms are disposed is reduced, thus making the valve operating device compact. Since motive power is directly transmitted from the intake valve operating cam to the cam contact portion of the intake rocker arm, improved followability to the valve operating cam can be ensured.

According to the sixth feature of the present invention, the fixed supporting shaft and the movable supporting shaft of the first and second link arms are placed inside a portion for linkage and connection of the intake rocker arm and the intake valve, and a portion of the exhaust valve operating device for swingably supporting the exhaust rocker arm is placed outside a portion for linkage and connection of the exhaust rocker arm and the exhaust valve. It is, therefore, possible to avoid mutual interference between the intake valve operating device and the exhaust valve operating device while avoiding an increase in size of the cylinder head even in a case where the angle contained between the intake valve and the exhaust valve is set small.

According to the seventh feature of the present invention, the plug cylinder is placed so as to avoid interference with the intake valve operating device and the exhaust valve operating device. This placement contributes to the effect of making the entire cylinder head more compact.

DESCRIPTION OF THE REFERENCE NUMERALS AND CHARACTERS

Figure 1:
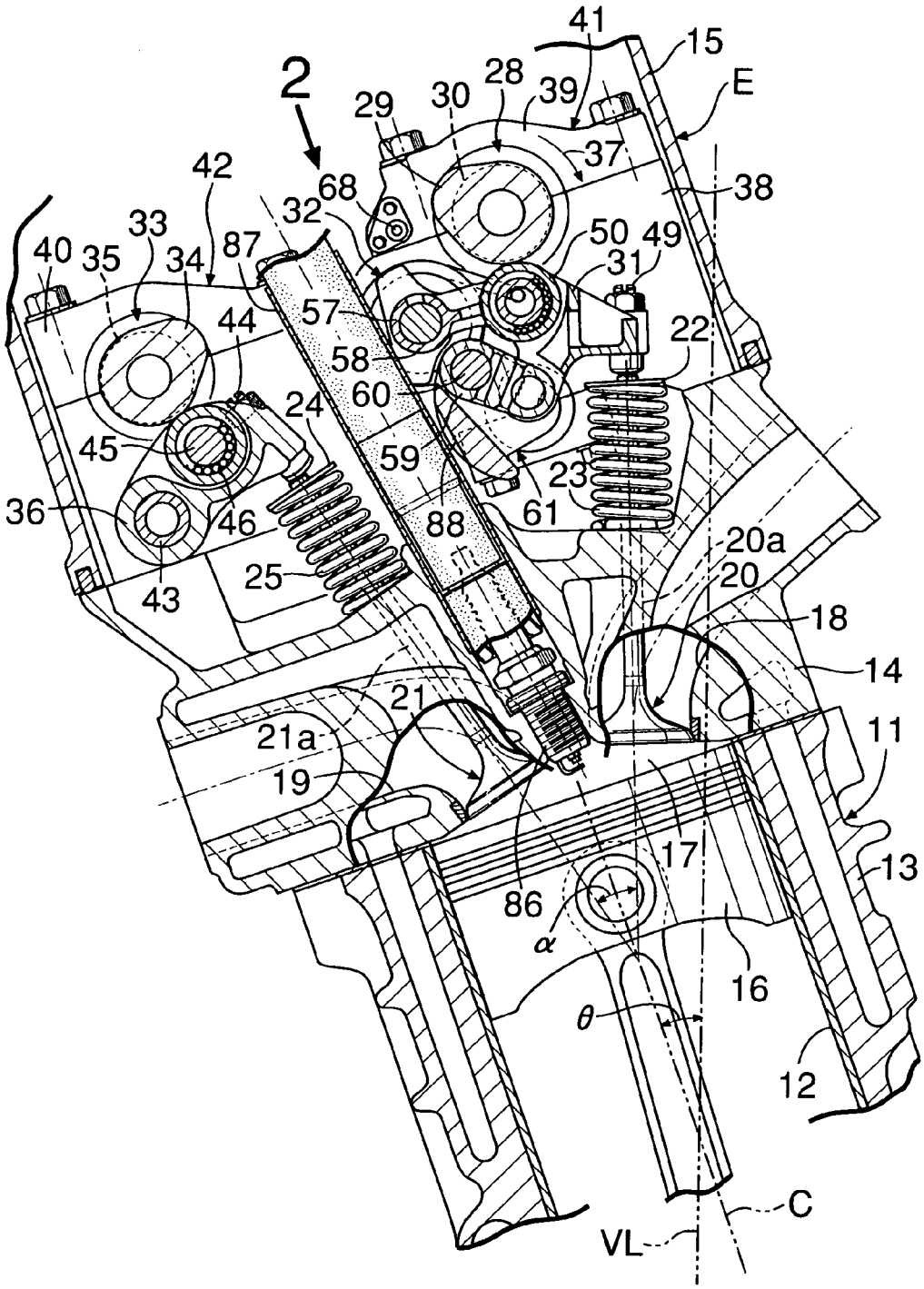
FIG. 1 is a partial longitudinal sectional view of an engine according to an embodiment of the present invention taken along line 1-1 of FIG. 2. (Embodiment 1)

11 . . . engine body
14 . . . cylinder head
17 . . . combustion chamber
20 . . . intake valve
21 . . . exhaust valve
28 . . . intake valve operating device
29 . . . intake valve operating cam
31 . . . intake rocker arm
32 . . . variable lift mechanism
33 . . . exhaust valve operating device
34 . . . exhaust valve operating cam
35 . . . exhaust camshaft
36 . . . exhaust rocker arm
37 . . . direction of rotation
39 . . . intake cam
43 . . . exhaust rocker shaft
50 . . . roller as a cam contact portion
57 . . . intake rocker shaft as a fixed supporting shaft
58 . . . first link arm
59 . . . second link arm
60 . . . movable supporting shaft
87 . . . plug cylinder
C . . . cylinder axis
E . . . engine

BEST MODE FOR CARRYING OUT THE INVENTION

A mode for carrying out the present invention will be described by way of one embodiment of the present invention with reference to the accompanying drawings.

EMBODIMENT 1

FIGS. 1 through 10 show one embodiment of the present invention.

Referring to FIG. 1, an engine body 11 of an in-line multicylinder engine E comprises a cylinder block 13 in which cylinder bores 12 are provided, a cylinder head 14 joined to a top face of the cylinder block 13, and a head cover 15 joined to a top face of the cylinder head 14. Pistons 16 are slidably fitted in the cylinder bores 12. Combustion chambers 17 facing tops of the pistons 16 are formed between the cylinder block 13 and the cylinder head 14.

The cylinder head 14 is equipped with intake ports 18 and exhaust ports 19 which can communicate with the combustion chambers 17. Each of the intake ports 18 is opened and closed by a pair of intake valves 20 while each of the exhaust ports 19 is opened and closed by a pair of exhaust valves 21. Valve springs 23 for biasing the intake valves 20 in the valve closing direction are provided between the cylinder head 14 and spring seats 22 provided at upper ends of stems 20*a* of the intake valves 20. Also, valve springs 25 for biasing the exhaust valves 21 in the valve closing direction are provided between the cylinder head 14 and spring seats 24 provided at upper ends of stems 21*a* of the exhaust valves 21.

An intake valve operating device 28 which drives the intake valves 20 for opening and closing operations includes an intake camshaft 30 having intake valve operating cams 29 in a one-to-one relationship with the cylinders, intake rocker arms 31 which swing by following the intake valve operating cams 29 and each of which is linked and connected in common to a pair of the intake valves 20 at each cylinder, and variable lift mechanisms 32 provided in a one-to-one relationship with the cylinders. An exhaust valve operating device 33 which drives the exhaust valves 21 for opening and closing operations includes an exhaust camshaft 35 having exhaust valve operating cams 34 in a one-to-one relationship with the cylinders, and exhaust rocker arms 36 which swing by following the exhaust valve operating cams 34 and each of which is linked and connected in common to a pair of the exhaust valves 21 at each cylinder.

The attitude of engine body 11 is set by being inclined toward the exhaust valve operating device 33 side so that the angle θ between a cylinder axis C and a vertical line VL is 20 degrees for example.

Figure 2:
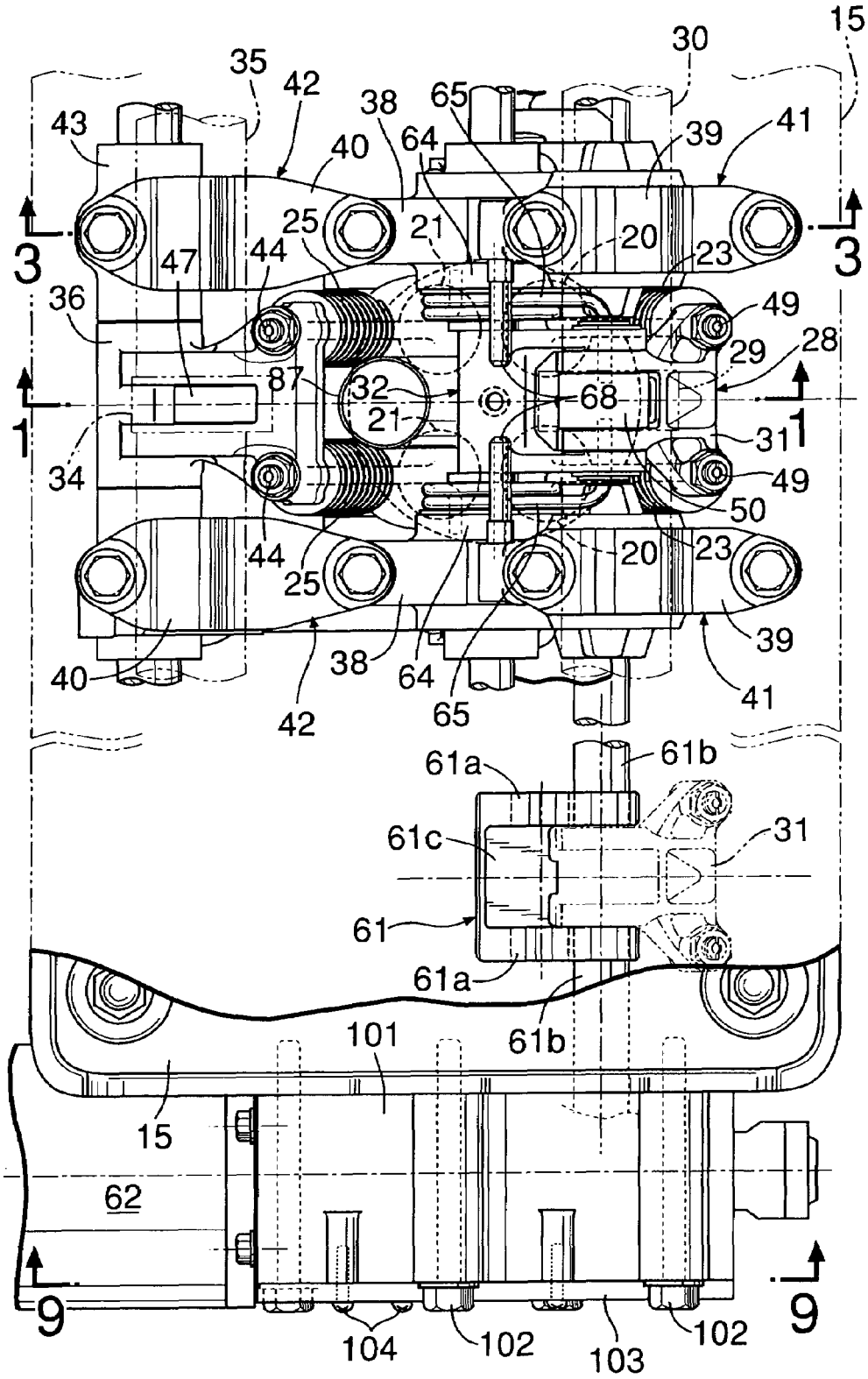
FIG. 2 is a sectional view taken along line 2-2 of FIG. 1. (Embodiment 1)
Figure 3:
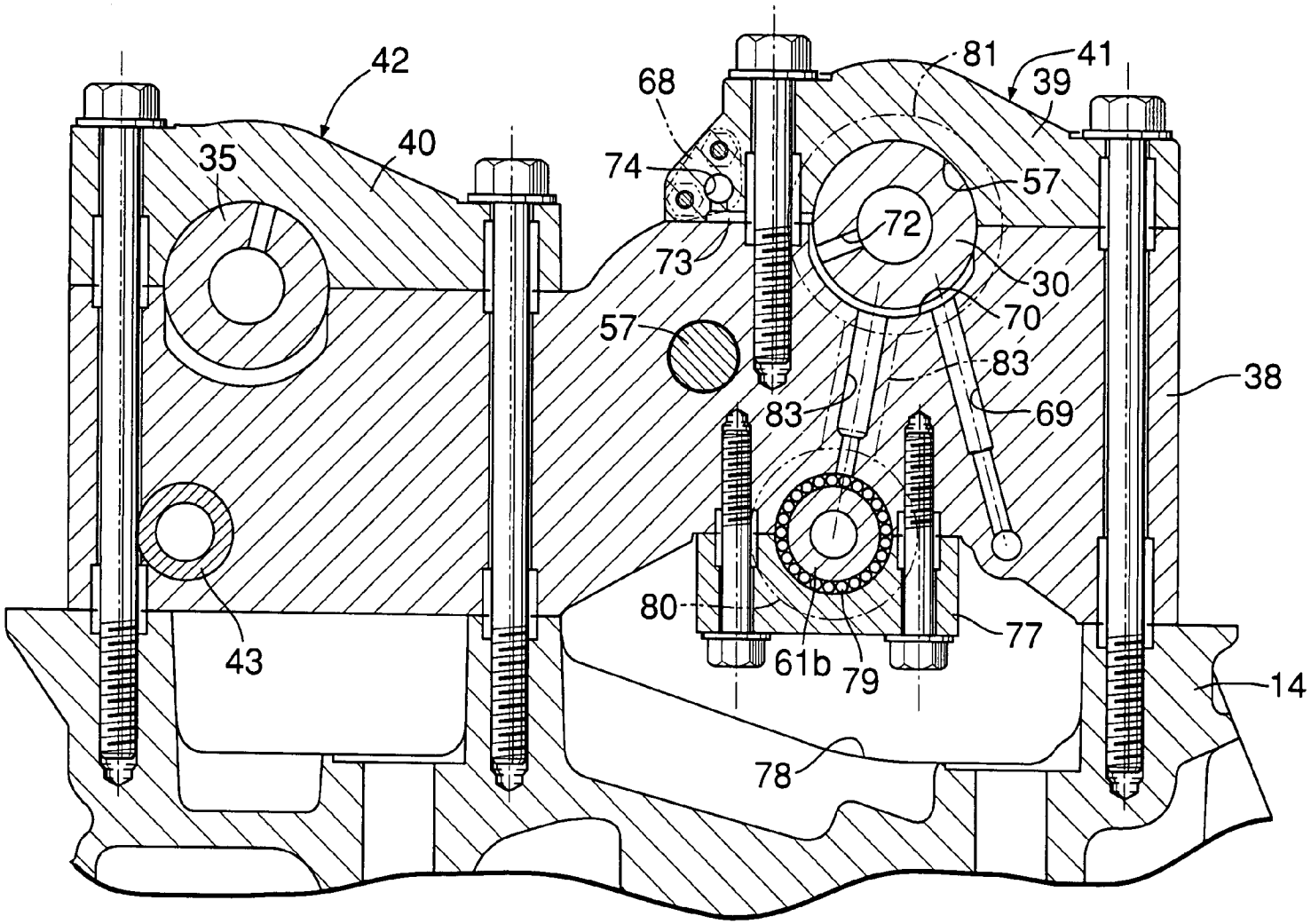
FIG. 3 is a sectional view taken along line 3-3 of FIG. 2. (Embodiment 1)

Referring also to FIGS. 2 and 3, upper holders 38 are fastened to the cylinder head 14, two upper holders 38 being disposed on opposite sides of each cylinder. Caps 39 and 40 forming intake cam holders 41 and exhaust cam holders 42 in association with the upper holders 38 are fastened to the upper holders 38 from above. Consequently, the intake camshaft 30 is rotatably supported between the upper holders 38 and the caps 39 forming the intake cam holders 39 while the exhaust camshaft 35 is rotatably supported between the upper holders 38 and the caps 40 forming the exhaust cam holders 42 in association with each other.

The upper surface of each upper holder 38 is stepped so that the distance between the portion supporting the intake camshaft 30 and the combustion chamber 17 is larger than the distance between the portion supporting the exhaust camshaft 35 and the combustion chamber 17. Thus, the intake camshaft 30 is disposed higher in position than the exhaust camshaft 35 by increasing the distance between the intake camshaft 30 and the combustion chamber 17 along the cylinder axis C of the engine body 11 relative to that between the exhaust camshaft 35 and the combustion chamber 17.

The intake camshaft 30 and the exhaust camshaft 35 are driven and rotated by motive power transmitted from a crankshaft (not shown) at a reduction ratio of 1/2 . The direction 37 of rotation of the intake camshaft 30 is set so that the intake camshaft 30 rotates by moving upward on the side where the intake camshaft 30 faces the exhaust valve operating device 33. The direction of rotation of the intake camshaft 30 is indicated as a clockwise direction in FIG. 1.

Each exhaust rocker arm 36 is swingably supported at its one end on an exhaust rocker shaft 43 having an axis parallel to the exhaust camshaft 35 and supported on the upper holder 38. A pair of tappet screws 44 which abut on upper ends of the stems 21*a* of the pair of exhaust valves 21 are screwed into the exhaust rocker arm 36 at the other end of the same so that their advance/retract positions are adjustable. A shaft 45 parallel to the exhaust rocker shaft 36 is provided at an intermediate portion of the exhaust rocker arm 36. A roller 47 which contacts the exhaust valve operating cam 34 in a rolling contact manner is axially supported on the exhaust rocker arm 36 with a roller bearing 46 interposed between the roller 47 and the shaft 45.

This exhaust valve operating device 33 is arranged on the cylinder head 14 so that the exhaust rocker arm 36 swingably-supporting portion, i.e., the exhaust rocker shaft 43, is placed outside the portion for linkage and connection of the exhaust rocker arm 36 to the exhaust valves 21, i.e., the tappet screws 44.

Figure 4:
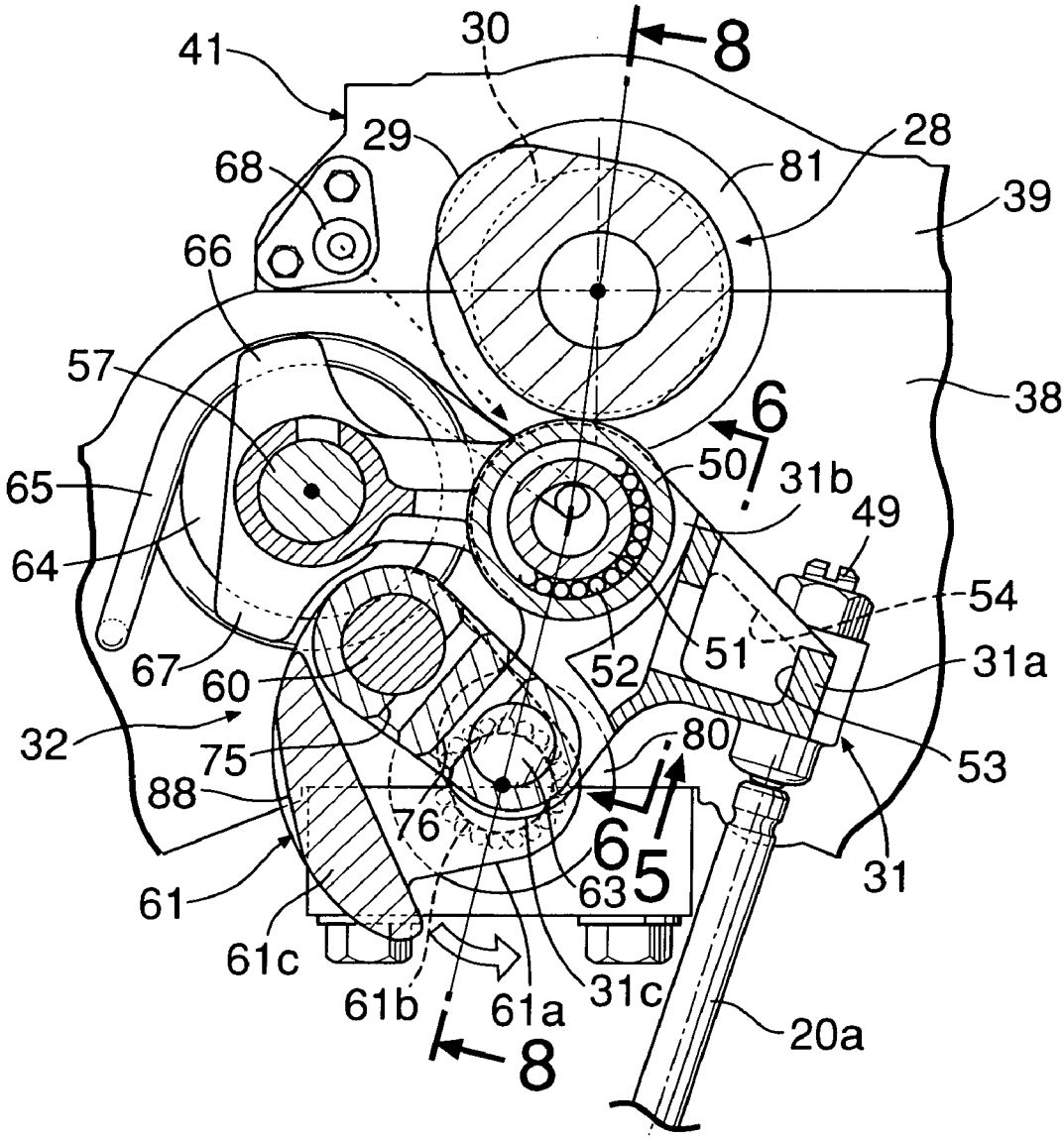
FIG. 4 is an enlarged view of an essential portion of FIG. 1. (Embodiment 1)
Figure 5:
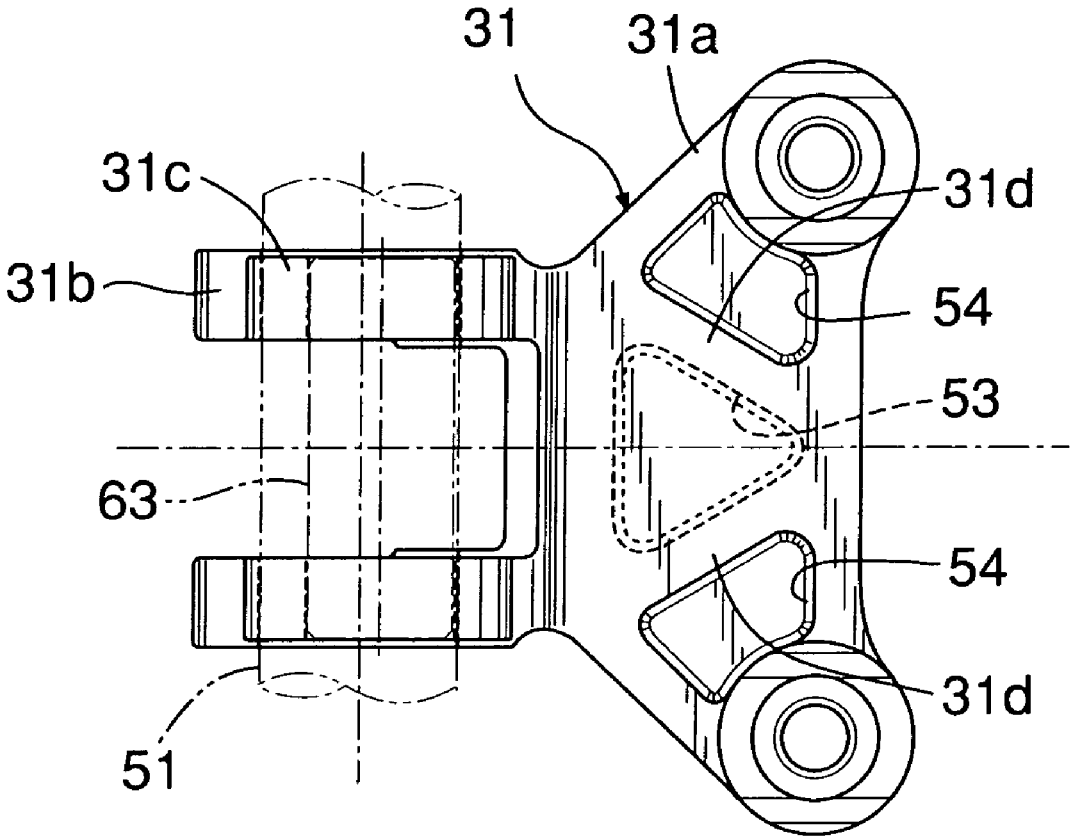
FIG. 5 is a bottom view of an intake rocker arm seen in the direction of arrow 5 in FIG. 4. (Embodiment 1)

Referring to FIGS. 4 and 5, each intake rocker arm 31 has a valve connection portion 31*a* provided at its one end. Tappet screws 49 which abut on upper ends of the stems 20*a* of the pair of intake valves 20 from above are screwed into the valve connection portion 31*a* so that their advance/retract positions are adjustable. The intake rocker arm 31 has at the other end a first supporting portion 31*b* and a second supporting portion 31*c* formed below the first supporting portion 31*b* continuously with the same, the first and second supporting portions 31*b* and 31*c* being formed as a generally U-shaped portion opened at the side opposite from the intake valves 20.

A roller 50 which contacts the intake valve operating cam 29 in a rolling contact manner is axially supported on the first supporting portion 31*b* of the intake rocker arm 31 by means of a roller bearing 52 and a first connection shaft 51. The roller 50 is interposed between opposite portions of the generally U-shaped first supporting portion 31*b*.

Figure 6:
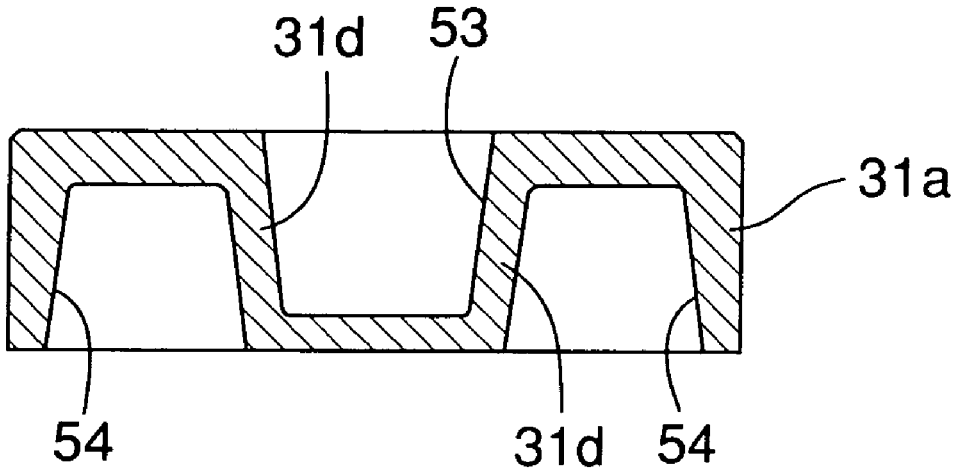
FIG. 6 is a sectional view taken along line 6-6 of FIG. 4. (Embodiment 1)

Referring also to FIG. 6, the intake rocker arm 31 is formed, for example, by die casting of a light alloy. A thinned portion 53 of a generally triangular shape for example is formed in a central portion of an upper surface of the valve connection portion 31*a*, and a pair of thinned portions 54 are formed in two portions of a lower surface of the valve connection portion 31*a* opposite from the upper surface in such a manner that the thinned portions 53 and 54 are alternately placed facing in opposite directions.

The thinned portions 53 and 54 are simultaneously formed at the time of die casting of the intake rocker arm 31. The upper thinned portion 53 has a draft in such a direction that the opening area of the thinned portion 53 is increased with approach toward the upper surface of the valve connection portion 31*a*, while the lower thinned portions 54 have drafts in such directions that the opening area of the thinned portion 54 is increased with approach toward the lower surface of the valve connection portion 31*a*. Accordingly, the slanting direction of the inner surface of the thinned portion 43 and the slanting direction of the inner surface of the thinned portions 44 are parallel to each other and wall portions 31*d* formed in the valve connecting portion 31*a* between the thinned portions 53 and 54 adjacent to each other are generally uniform in thickness.

Figure 7:
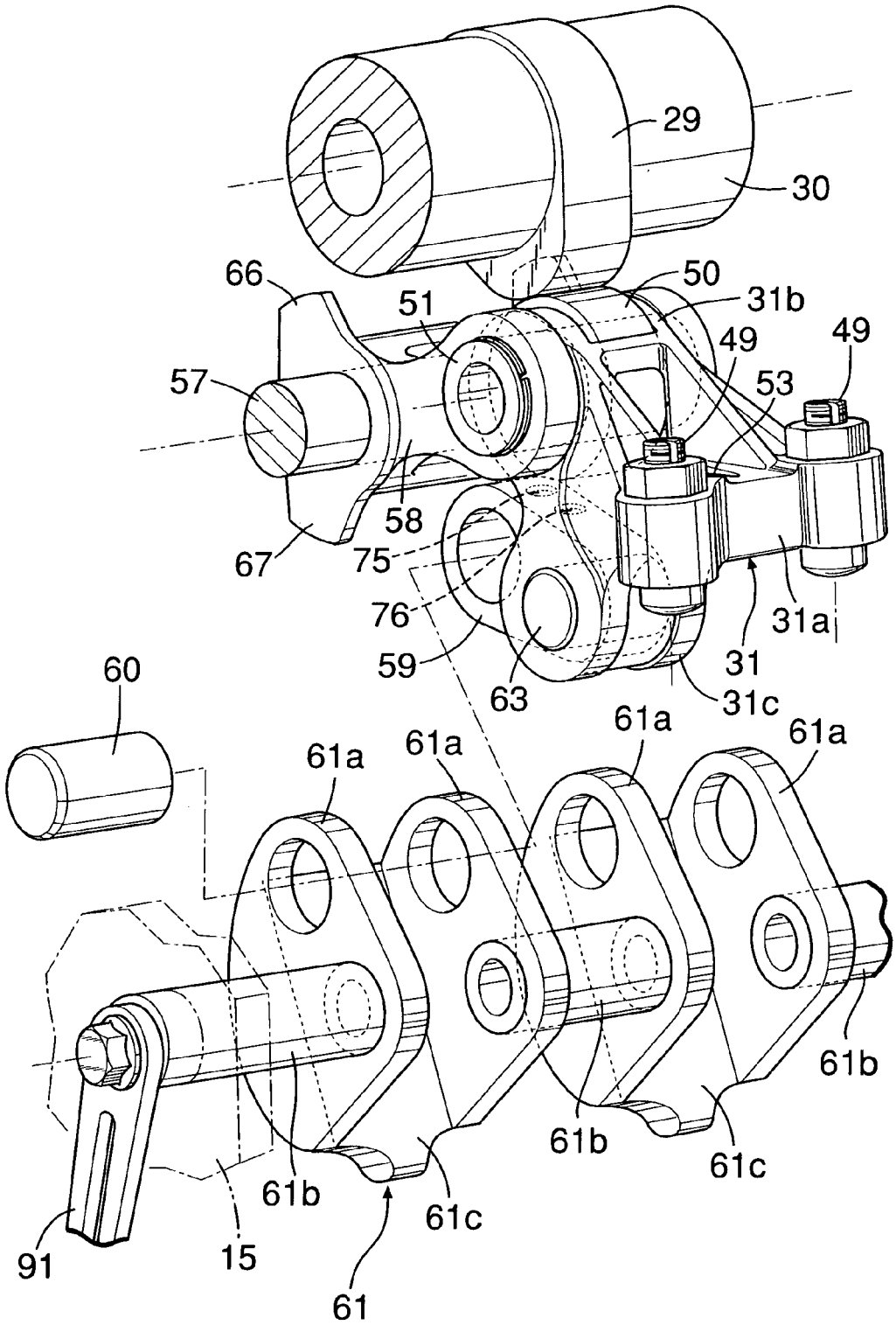
FIG. 7 is a perspective view of a variable lift mechanism. (Embodiment 1)
Figure 8:
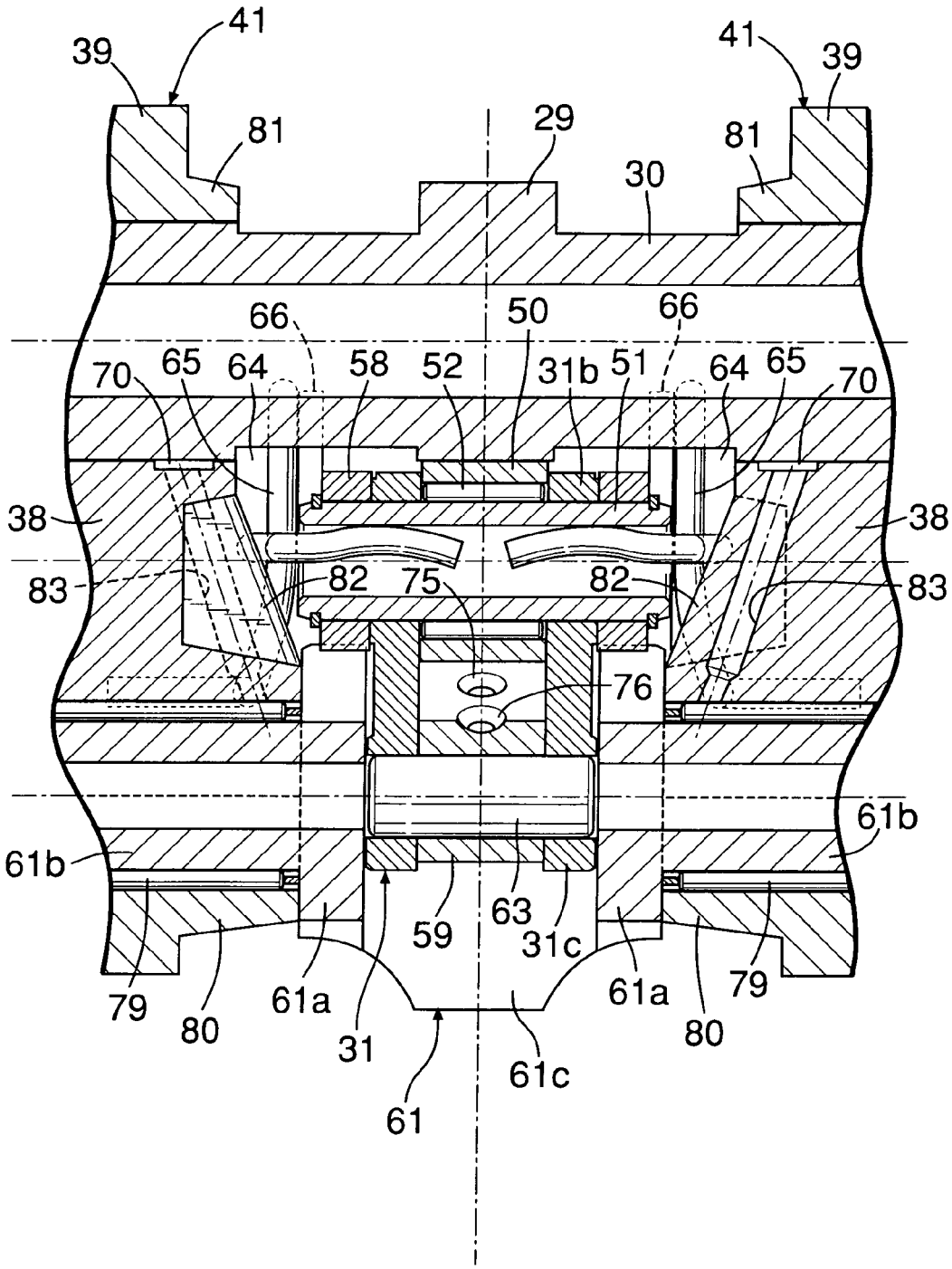
FIG. 8 is a sectional view taken along line 8-8 of FIG. 4. (Embodiment 1)

Referring also to FIGS. 7 and 8, the variable lift mechanism 32 has a first link arm 58 having one end turnably connected to the first supporting portion 31*b* of the intake rocker arm 31 and the other end turnably supported at a fixed position on the engine body 11 by an intake rocker shaft 5 provided as a fixed supporting shaft, a second link arm 59 having its one end turnably connected to the second supporting portion 31*c* of the intake rocker arm 31, a movable supporting shaft 60 which turnably supports the second link arm 59 at the other end, a control shaft 61 connected to the movable supporting shaft 60 to enable angular displacement of the movable supporting shaft 60 about an axis parallel to the axis of the movable supporting shaft 60, and an actuator motor 62 connected to the control shaft 61 to cause an angular displacement of the movable shaft 60.

One end of the first link arm 58 is formed so as to be generally U-shaped and sandwich the first supporting portion 31*b* of the intake rocker arm 31 from opposite sides and is turnably connected to the first supporting portion 31*b* by the first connection shaft 51 that axially supports the roller 50 on the intake rocker arm 31. The intake rocker shaft 57 that turnably supports the other end of the first link arm 58.is supported on the upper holders 38 fastened to the cylinder head 14.

One end of the second link arm 59 placed below the first link arm 58 is placed so as to be sandwiched in the second supporting portion 31*c* of the intake rocker arm 31 and is turnably connected to the second supporting portion 31*c* by the second connection shaft 63.

Supporting bosses 64 are provided in the form of projections integrally on the upper holders 38 on the opposite sides of the other end of the first link arm 58 to support the intake rocker shaft 57. The movement of the intake rocker shaft 57 in the axial direction at the other end of the first link arm 58 is limited by these supporting bosses 64.

The two intake valves 20 are biased in the valve closing direction by the valve springs 23. When the two intake valves 20 spring-biased in the valve closing direction are driven in the valve opening direction by the intake rocker arm 31, the roller 50 of the intake rocker arm 31 is maintained in contact with the intake valve operating cam 29 by the action of the valve springs 23. However, when the intake valves 20 are in the closing state, the spring force of the valve springs 23 does not act on the intake rocker arm 31 to retrain the roller 50 from moving apart from the intake valve operating cam 29. There is a possibility of the valve lift control accuracy being reduced when the intake valves 20 are slightly opened. Therefore, the intake rocker arm 31 is biased by rocker arm bias springs 65 separate from the valve springs 23 in such a direction as to be brought into abutment against the intake valve operating cam 29.

The rocker arm bias springs 65 are coiled torsional springs surrounding the supporting bosses 64 and provided between the engine body 11 and the intake rocker arm 31. That is, ends of the rocker arm bias springs 65 engage with the supporting bosses 64 while the other ends of the rocker arm bias springs 65 are inserted in, and engage with, the first connection shaft 51 provided as a hollow shaft operating integrally with the intake rocker arm 31.

A portion of the first link arm 58 at the other end is formed into a cylindrical shape, with its circumference placed so as to be seen inside the circumference of the rocker arm bias springs 65 wound in coil form, when laterally viewed. At axially opposite ends of the other end portion of the first link arm 58, a plurality of projections, e.g., a pair of projections 66 and 67, spaced circumferentially from each other, are provided to prevent the rocker arm bias springs 65 from falling toward the first link arm 58. Thus, while increasing the size of the other end portion of the first link arm 58 is avoided, the above-described falling of the rocker arm bias springs 65 can be prevented and the supporting rigidity of the other end portion of the first link arm 58 can be increased.

The projections are kept clear of the working area of the second link arm 59, thereby maintaining the desired working area of the second link arm 59, even though the projections 66 and 67 are provided on the other end portion of the first link arm 58.

Oil jets 68 for supplying oil toward an upper portion of the intake rocker arm 31 at the other end are mounted on the caps 39 in the intake cam holders 41 provided on the engine body 11.

A path 69 for conducting oil from an oil pump (not shown) is provided in one of the plurality of upper holders 38. Circular-arc recesses 70 are formed in upper portions of the upper holders 38 so as to face the lower-half of the intake camshaft 30. The path 69 communicates with one of the circular-arc recesses 70. On the other hand, an oil path 71 is coaxially formed in the intake camshaft 30. Communication holes 72 having inner ends communicating with the oil path 71 are formed in the intake camshaft 30 at positions corresponding to the intake cam holders 41 so as to have openings formed at their outer ends in the outer surface of the intake camshaft 30. Lubricating oil is supplied to the gap between the cam holders 41 and the intake camshaft 30 via the communication holes 72.

Also, recesses 73 are provided in lower surfaces of the caps 39 forming the intake cam holders 41 in association with the upper holders 38. The recesses 73 are formed as paths between the lower surfaces of the caps 39 and the upper surfaces of the upper holders 38 so as to communicate with the recesses 70. The oil jets 68 are mounted on the caps 39 so as to communicate with paths 74 formed in the caps 39 for communication with the recesses 73.

Thus, the oil jets 68 are mounted on the caps 39 of the intake cam holders 46 provided on the engine body 11 so as to rotatably support the intake camshaft 30, thereby enabling a sufficient amount of oil to be supplied at a sufficiently high pressure from the oil jets 68 by using the oil paths for lubrication between the intake camshaft 30 and the intake cam holders 41.

Also, oil is supplied from the oil jets 68 toward the first connection shaft 51 in the upper position in the first and second connection shafts 51 and 63 by which ends of the first and second link arms 58 and 59 are connected to the intake rocker arm 31, so that the oil that has lubricated between the first link arm 58 and the intake rocker arm 31 flows down to the second link arm 59 in the lower position.

Oil introduction holes 75 and 76 having intermediate portions facing portions of the movable supporting shaft 60 and the second connection shaft 63 are provided in the second link arm 59 in a direction perpendicular to a straight line connecting the axes of the movable supporting shaft 60, and the second connection shaft 63 and the oil introduction holes 75 and 76 have openings facing the first connection shaft 51. Therefore, the oil flowing downward from the first link ark 58 is effectively led to the gap between the second link arm 59 and the movable supporting shaft 60 and the gap between the second link arm 59 and the second connection shaft 63. Thus, lubrication on the intake rocker arm 31, lubrication in the connection between the first and second link arms 58 and 59 and lubrication between the second link arm 59 and the movable supporting shaft 60 can be performed by means of a simple lubrication structure having a reduced number of component parts to ensure smooth valve operations.

The control shaft 61 is a single shaft supported on the engine body 11 as a common component associated with the plurality of cylinders arranged in-line. The control shaft 61 is formed into a cranked shape and has, in correspondence with each cylinder, two webs 61*a* placed on the opposite sides of the intake rocker arm 31, journals 61*b* rotatably supported on the engine body 11 and a connecting portion 61*c* which connects the two webs 61*a*. The movable supporting shaft 60 is connected to the control shaft 61 so as to connect each pair of webs 61*a*.

Each journal 61*b* of the control shaft 61 is rotatably supported between the upper holder 38 connected to the cylinder head 14 of the engine body 11 and a lower holder 77 connected to the upper holder 38 from below. The lower holder 77 is formed separately from the cylinder head 14 and fastened to the upper holder 38. A recess 78 for allowing placement of the lower holder 77 is provided in the upper surface of the cylinder head 14.

Roller bearings 79 are interposed between the upper and lower holders 38 and 77 and the journals 61*b*. The roller bearings 79 are of a bisectable type since they are interposed between the upper and lower holders 38 and 77 and the journals 61*b* of the control shaft 61 having the plurality of webs 61*a* and connecting portions 61*c* and provided as a common component associated with the plurality of cylinders.

Control shaft supporting bosses 80 which project to the web 61*a* sides of the control shaft 61 are formed on the upper and lower holders 38 and 77 so as to pass through the journals 61*a*. On the upper holders 38 and the caps 39 connected to each other to form the intake cam holders 41 in association with each other, camshaft supporting bosses 81 through which the intake camshaft 30 is passed are formed so as to project toward the intake rocker arms 31. On the upper holders 38, ribs 82 for connection between the control shaft supporting bosses 80 and the camshaft supporting bosses 81 are integrally formed so as to project therefrom.

Paths 83 for conducting oil to the roller bearings 79 are provided in the ribs 82 to provide communication with the recesses 70 in the upper surfaces of the upper holders 38.

While the exhaust valve operating device 33 is arranged on the cylinder head 14 so that the exhaust rocker arm 36 swingably-supporting portion is placed outside the portion for linkage and connection of the exhaust rocker arm 36 to the exhaust valves 21, the above-described intake valve operating device 28 is arranged on the cylinder head 14 so that the intake rocker shaft 57 and the movable supporting shaft 60 are placed inside the portion for linkage and connection of the intake rocker arm 31 to the intake valves 20.

Further, a plug cylinder 87 in which an ignition plug 86 is inserted to be mounted in the cylinder head 14 so as to face the combustion chamber 17 is provided in the cylinder head 14 between the intake valve operating device 28 and the and the exhaust valve operating device 33. The plug cylinder 87 is inclined by being brought closer to the exhaust valve operating device at a position closer to its upper end.

Thus, the control shaft 61 in the intake valve operating device 28 is placed between the intake valves 20 and the plug cylinders 87, with outer surfaces of the connecting portions 61*c* facing the plug cylinders 87. Clearance grooves 88 for avoiding interference with the plug cylinders 87 are formed in the outer surfaces of the connecting portions 61*c*.

When the intake valves 20 are in the closing state, the second connection shaft 63 that connects the second link arm 59 to the intake rocker arm 31 is coaxial with the journals 61*b* of the control shaft 61. When the control shaft 61 swings about the axis of the journals 61*b*, the movable supporting shaft 60 moves on a circular arc of a circle the center of which corresponds to the axis of the journals.

Figure 9:
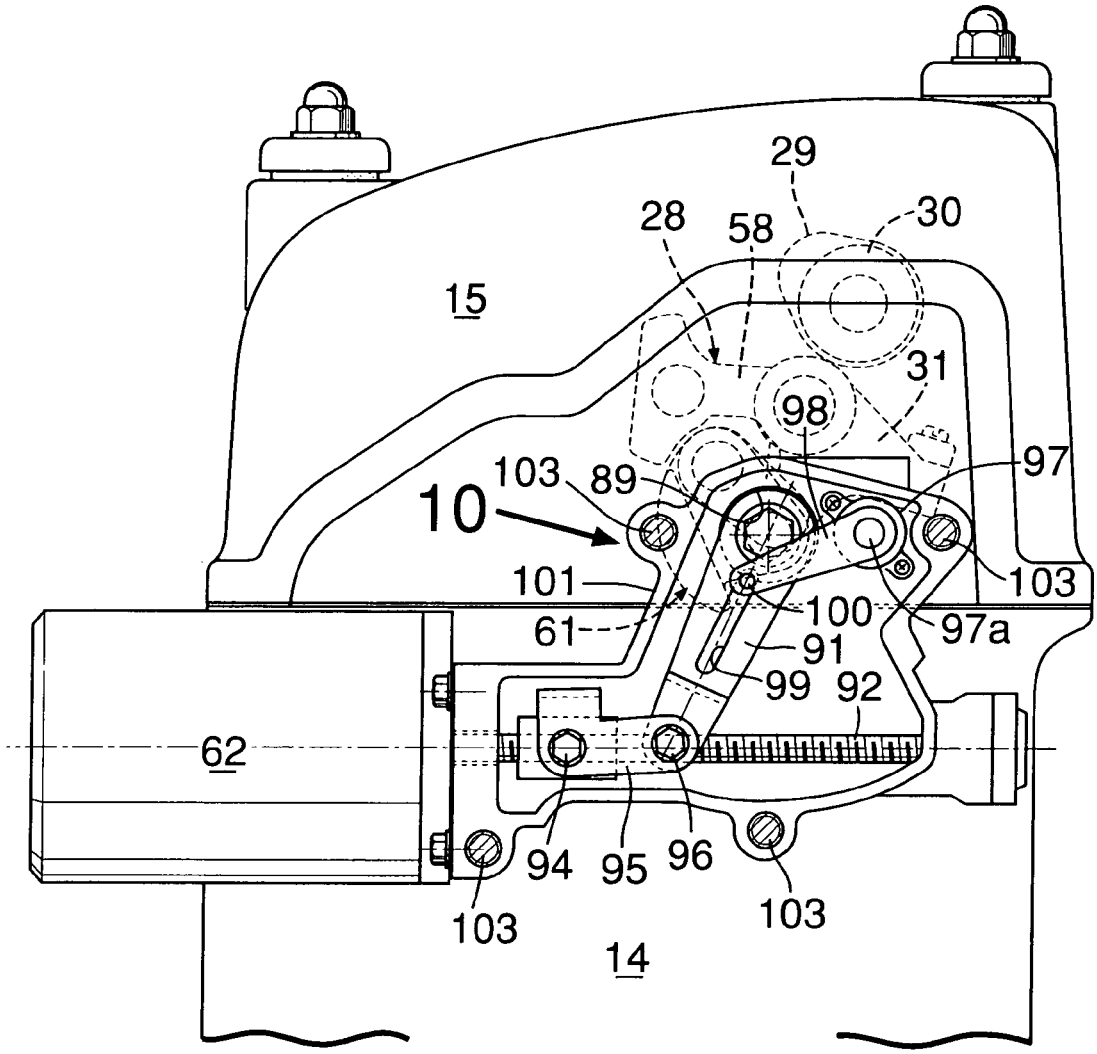
FIG. 9 is a sectional view taken along line 9-9 of FIG. 2. (Embodiment 1)
Figure 10:
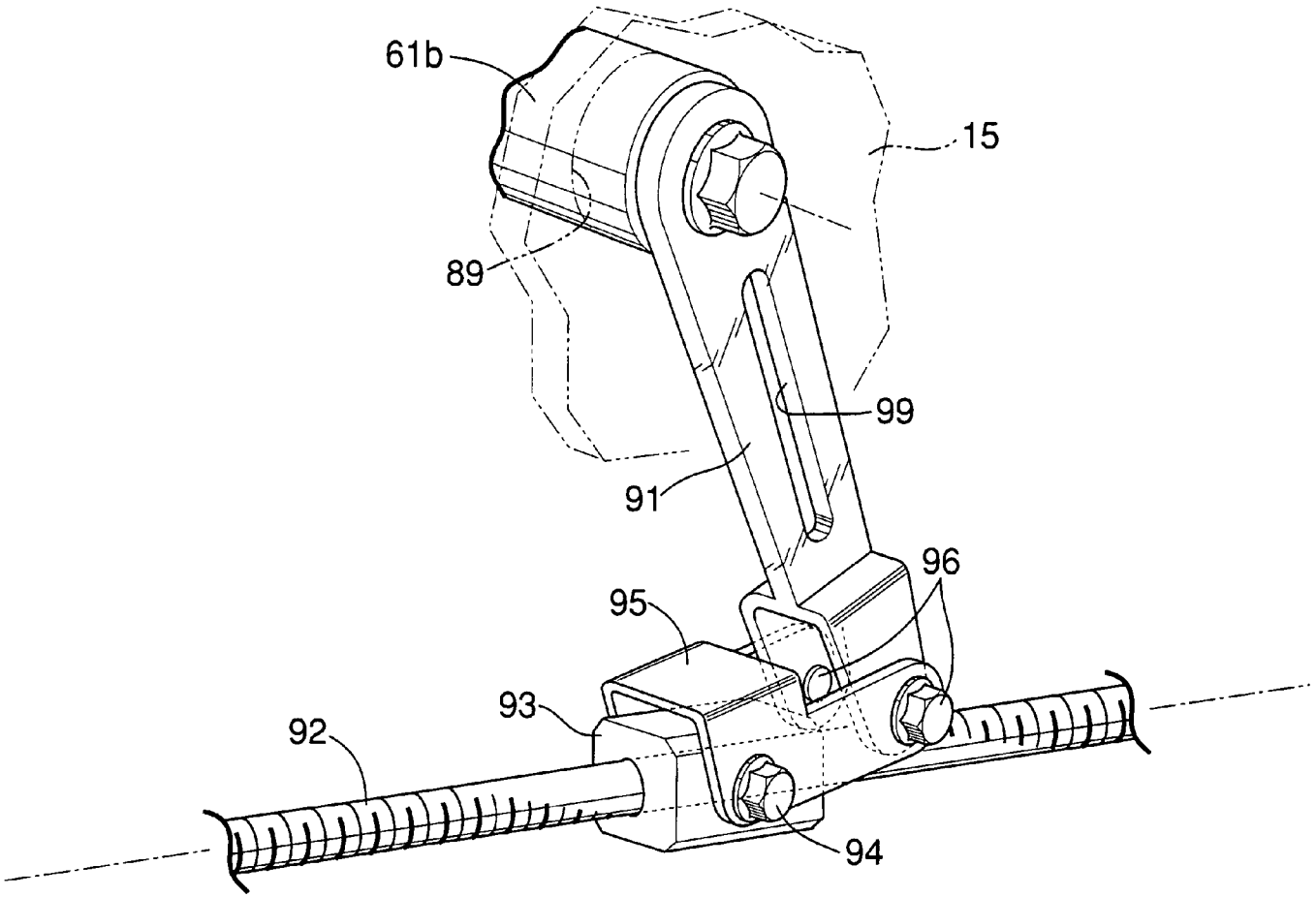
FIG. 10 is a perspective view seen in the direction of arrow 10 in FIG. 9. (Embodiment 1)

Referring to FIGS. 9 and 10, one of the journals 61*b* of the control shaft 61 sticks out from a support hole 89 provided in the head cover 15. A control arm 91 is fixed to the tip of the journal 61*b* and driven by the actuator motor 62 mounted on an outer wall of the cylinder head 14. That is, a nut member 93 meshes with a threaded shaft 92 rotated by the actuator motor 62, and a connecting link 95 having its one end pivotally supported by a pin 94 is connected at the other end to the control arm 91 by pins 96. Therefore, when the actuator motor 62 is made to operate, the nut member 93 moves along the rotating threaded shaft 92, and the control shaft 61 is caused to swing around the journal 61*b* by the control arm 91 connected to the nut member 93 by the connecting link 95, thereby causing a displacement of the movable supporting shaft 60.

A rotational angle sensor 97 such as a rotary encoder is installed on an outer wall surface of the head cover 15 with one end of a sensor arm 98 fixed to the tip of a sensor shaft 97*a*. A guide groove 99 is formed in the control arm 91 so as to extend linearly in the lengthwise direction of the control arm 91, and a connecting shaft 100 mounted on the other end of the sensor arm 98 is slidably fitted in the guide groove 99.

The threaded shaft 92, nut member 93, pin 94, connecting link 95, pins 96, control arm 91, rotational angle sensor 97, sensor arm 98, and connecting shaft 100 are housed in a case 101 mounted on side surfaces of the cylinder head 14 and the head cover 15 with bolts 102. A cover 103 which covers open end faces of the case 101 is mounted on the case 101 by with screw members 104.

In the variable lift mechanism 32, when the control arm 91 is turned counterclockwise by the actuator motor 62 from the position indicated in FIG. 9, the control shaft 61 connected to the control arm 91 also turns counterclockwise to move the movable supporting shaft 60 downward. When the intake valve operating cam 29 on the intake camshaft 30 pushes the roller 50 in this state, a four-bar link joining the intake rocker shaft 57, the first connection shaft 51, the second connection shaft 63 and the movable supporting shaft 60 deforms and causes the intake rocker arms 31 to swing downward. The tappet screws 49 thereby push the stems 20*a* of the intake valves 20, finally opening the intake valves 20 with a low lift.

When the control arm 91 is turned to the solid-line position in FIG. 9 by the actuator motor 62, the control shaft 61 connected to the control arm 91 turns clockwise to move the movable supporting shaft 60 upward. When the intake valve operating cam 29 on the intake camshaft 30 pushes the roller 50 in this state, the four-bar link deforms and causes the intake rocker arms 31 to swing downward. The tappet screws 49 thereby push the stems 20*a* of the intake valves 20, finally opening the intake valves 20 with a high lift.

The operation of this embodiment will now be described. The intake camshaft 30 is placed higher in position than the exhaust camshaft 35 by increasing the distance between the intake camshaft 30 and the combustion chamber 17 along the cylinder axis C of the engine body 11 relative to that between the exhaust camshaft 35 and the combustion chamber 17, thereby making it easier to cause lubricating oil to flow to the exhaust valve operating device 33 after lubrication and cooling of the intake valve operating device 28 maintained at a comparatively low temperature, and making it possible to efficiently lubricate and cool the exhaust valve operating device 33 under thermally severe conditions.

The intake valve operating device 28 has the variable lift mechanism 32 capable of changing the valve opening lift of the intake valve 20, and the exhaust valve operating device 33 has the exhaust camshaft 35 and the exhaust rocker arm 36 linked and connected to the exhaust valves 21 so as to be able to swing by following the exhaust camshaft 35. The lift of the intake valves 20 is changed by the variable lift mechanism 32. In this way, the amount of air intake can be controlled without using the throttle valve. Moreover, the variable lift mechanism 32 can be effectively arranged in a space on the intake valve operating device 28 side where there is room larger than that on the exhaust valve operating device 33 side.

The attitude of engine body 11 is set so that the cylinder axis C is inclined toward the exhaust valve operating device 33. Therefore, lubricating oil flows efficiently to the exhaust valve operating device 33 after lubricating and cooling the intake valve operating device 28. Thus, lubrication and cooling of the exhaust valve operating device 33 can performed more efficiently.

The direction 37 of rotation of the intake camshaft 30 is set so that the intake camshaft 30 rotates by moving upward on the side where the intake camshaft 30 faces the exhaust valve operating device 33. An upward splash of the lubricating oil toward the exhaust valve operating device 33 is caused by this rotation of the intake camshaft 30 to more efficiently lubricate and cool the exhaust valve operating device 33.

In the variable lift mechanism 32 for continuously changing the valve opening lift of the intake valves 20, ends of the first and second link arms 58 and 59 are connected relatively movably in parallel with each other to the intake rocker arm 31 having valve connection portion 31*a* linked and connected to the pair of intake valves 20, the other end of the first link arm 58 is turnably supported by the intake rocker shaft 57 supported on the engine body 11, and the other end of the second link arm 59 is turnably supported by the movable supporting shaft 60 capable of being displaced.

Therefore, the lift of the intake valves 20 can be steplessly changed by steplessly displacing the movable supporting shaft 60. Also, ends of the first and second link arms 58 and 59 are turnably connected directly to the intake rocker arm 31, so that the space in which the two link arms 58 and 59 are disposed is reduced, thus making the valve operating device compact. Since motive power is directly transmitted from the intake valve operating cam 29 to the roller 50 of the intake rocker arm 31, improved followability to the intake valve operating cam 29 can be ensured. Also, the intake rocker arm 31 and the first and second link arms 58 and 59 can be disposed at substantially the same position in the direction along the axis of the intake camshaft 30, thereby making the intake valve operating device 28 compact in the direction along the intake camshaft 30.

One end of the first link arm 58 is turnably connected to the intake rocker arm 31 by the first connection shaft 51, and the roller 50 is axially supported on the intake rocker arm 31 by the first connection shaft 51. That is, connection of one end of the first link arm 58 to the intake rocker arm 31 allowing rotation of the first link arm 58 and axial support of the roller 50 on the intake rocker arm 31 are achieved by means of the first connection shaft 51, thus reducing the number of component parts and making the intake valve operating device 28 more compact.

In the intake valve operating device 28 having the variable lift mechanism 32 in the intake and exhaust valve operating devices 28 and 33, the intake rocker shaft 57 and the movable supporting shaft 60 are placed inside the portion for linkage and connection of the intake rocker arm 31 to the intake valves 20, while the portion of the exhaust valve operating device 33 for swingably supporting the exhaust rocker arm 36 is placed outside the portion for linkage and connection of the exhaust rocker arm 36 to the exhaust valves 21. It is, therefore, possible to avoid mutual interference between the intake valve operating device 28 and the exhaust valve operating device 33 while avoiding an increase in size of the cylinder head 14 even in a case where the angle $\alpha$ contained between the intake valves 20 and the exhaust valves 21 (see FIG. 1) is set small in order to reduce the size of the combustion chamber 17 to obtain good combustion.

The exhaust valve operating device 33 has the exhaust camshaft 35 having the exhaust valve operating cams 34, and the exhaust rocker arms 36 swingably supported on the engine body 11 by the exhaust rocker shaft 43 to swing by following the exhaust valve operating cam 35 and linked and connected to the exhaust valves 21. Also, the plug cylinder 68 placed between the intake valve operating device 28 and the exhaust valve operating device 33 is mounted in the cylinder head 14 by being inclined so as to be brought closer to the exhaust valve operating device 33 at a position closer to its upper end. Thus, the plug cylinder 68 is placed so as to avoid interference with the intake valve operating device 28 and the exhaust valve operating device 33. This placement contributes to the effect of making the entire cylinder head 14 more compact.

The control shaft 61 provided in the variable link mechanism 32 of the intake valve operating device 28 is connected to the movable supporting shaft 60 to enable angular displacement of the movable supporting shaft 60 about an axis parallel to the axis of the movable supporting shaft 60 and is supported on the engine body 11 on the opposite sides of the intake rocker arm 31. The rigidity of the support for the control shaft 61 is increased by adopting the dual-support structure to enable variable-lift control on the intake valves 20 to be performed with accuracy.

The above-described single control shaft 61 is supported on the engine body 11 as a common component associated with the plurality of cylinders arranged in-line. It is, therefore, possible to make the engine E compact by avoiding increasing the number of component parts.

Moreover, the control shaft 61 is formed into a cranked shape and has the two webs 61*a* placed on the opposite sides of the intake rocker arm 31, the journals 61*b* joined perpendicularly to outer surfaces of base end portions of the two webs 61*a* and turnably supported on the engine body 11, and the connecting portion 61C that connects the two webs 61*a*. The movable supporting shaft 60 is connected to the control shaft 61 so as to connect the two webs 61. Therefore, the rigidity of the control shaft 61 driven to be angularly displaced can be increased.

The journals 61*b* of the control shaft 61 are rotatably supported between the upper holders 38 connected to the cylinder head 14 of the engine body 11 and the lower holders 77 connected to the upper holders 38 from below. Thus, the facility with which the control shaft 61 is mounted to the engine body 11 can be improved. Further, since the lower holders 77 separate from the cylinder head 14 is fastened to the upper holders 38, the degree of freedom with which the cylinder head 14 is designed with respect to support for the control shaft 61 can be increased.

The bisectable roller bearings 79 are interposed between the upper and lower holders 38 and 77 and the journals 61*b* to improve the facility with which the control shaft 61 is mounted to the engine body 11 while reducing the loss due to friction at the portions supporting the control shaft 61.

The control shaft supporting bosses 80 projecting to the sides of the webs 61*a* of the control shaft 61 are formed on the upper and lower holders 38 and 77 connected to each other, and the journals 61*b* passed through the control shaft supporting bosses 80 are turnably supported between the upper and lower holders 38 and 77. Therefore, the rigidity of the support for the control shaft 61 can be further increased.

The camshaft supporting bosses 81 projecting toward the intake rocker arm 31 are formed on the upper holders 38 and the caps 39 connected to the upper holders 38 from above. The intake camshaft 30 is passed through the camshaft supporting bosses 81 and rotatably supported between the upper holders 38 and the caps 39. It is, therefore, possible to increase the rigidity of the support for the intake camshaft 30 while minimizing the number of component parts for supporting the intake camshaft 30.

The ribs 82 for connection between the control shaft supporting bosses 80 and the camshaft supporting bosses 81 are formed on the upper holders 38 so as to project from the same to further increase the rigidity of the supports for the control shaft 61 and the intake camshaft 30.

The control shaft 61 is placed between the intake valves 20 and the plug cylinders 87 provided in the cylinder head 14, with the outer surfaces of the connecting portions 61*c* facing the plug cylinders 87. The clearance grooves 88 for avoiding interference with the plug cylinders 87 are formed in the outer surfaces of the connecting portions 61*c*. Therefore, the plug cylinders 87 can be placed closer to the intake valve operating device 28 to make the engine E compact.

The intake rocker arm 31 of the intake valve operating device 28 has thinned portions 53 and 54 formed in surfaces of the valve connecting portion 61*a* opposite from each other, the thinned portions 53 and 54 being alternately placed facing in opposite directions. Therefore, the intake rocker arm 31 can be reduced in weight.

The thinned portions 53 and 54 are simultaneously formed at the time of die casting of the intake rocker arm 31. Each of the adjacent pairs of the thinned portions 53 and 54 have drafts in directions reverse to each other, such that the inner surfaces of the adjacent pair of the thinned portions 53 and 54 are inclined in the same direction. Therefore, the wall portions 31*d* formed in the intake rocker arm 31 between the thinned portions 53 and 54 adjacent to each other are generally uniform in thickness. The desired rigidity of the intake rocker arm 31 can be maintained by forming the wall portions 31*d* generally uniform in thickness.

The intake valve operating device 28 has the variable lift mechanism 32 capable of steplessly changing the lift of the intake valves 20. Therefore, the number of component parts in the intake valve operating device 28 is comparatively large. Even in the intake valve operating device 28 having the variable lift mechanism 32 liable to be a cause of an increase in weight of the intake valve operating device 28, the weight of the intake valve operating device 28 can be reduced by reducing the weight of the intake rocker arm 31, thereby increasing the critical rotational speed.

The embodiment of the present invention is as described above. The present invention, however, is not limited to the embodiment described above. Various changes in the design can be made without departing from the scope of the invention described in the appended claims.

For example, the embodiment has been described with respect to a case where the plug cylinder 87 is placed between the intake valve operating device 28 and the exhaust valve operating device 33, the present invention can also be applied to an engine in which a fuel injection valve for directly injecting fuel into the combustion chamber 17 is placed between the intake valve operating device 28 and the exhaust valve operating device 33.

The invention claimed is:

1. An engine comprising:

a cylinder head (14) forming a portion of an engine body (11);

an intake valve operating device (28) having an intake camshaft (30);

an intake valve (20) driven for opening and closing operations by the intake valve operating device (28), the intake valve (20) being provided in the cylinder head (14);

an exhaust valve operating device (33) having an exhaust camshaft (35); and an exhaust valve (21) driven for opening and closing operations by the exhaust valve operating device (33), the exhaust valve (21) being provided in the cylinder head (14), characterized in that the intake camshaft (30) is placed higher in position than the exhaust camshaft (35) by increasing the distance between the intake camshaft (30) and a combustion chamber (17) along a cylinder axis (C) of the engine body (11) relative to the distance between the exhaust camshaft (35)and the combustion chamber (17), wherein the intake valve operating device (28) has a variable lift mechanism (32) capable of changing the valve opening lift amount of the intake valve (20), and the exhaust valve operating device (33) has the exhaust camshaft (35) and an exhaust rocker arm (36) linked and connected to the exhaust valve (21) so as to swing by following the exhaust camshaft (35), and wherein the intake valve operating device (28) includes the intake camshaft (30) having an intake valve operating cam (29), an intake rocker arm having a cam contact portion (50) which contacts the intake valve operating cam (29), the intake rocker arm (31) being liked and connected to the intake valve (20) so as to apply a force to the intake valve (20) in the valve opening direction, and the variable lift mechanism (32), and wherein the variable lift mechanism (32) has a first link arm (58) having one end thereof turnably connected to the intake rocker arm (31) and the other end turnably supported at a fixed position on the engine body (11) through a fixed supporting shaft (57), and a second link arm (59) having one end thereof turnably connected to the intake rocker arm (31) and the other end turnably supported on a movable supporting shaft (60) capable of being displaced.

2. The engine according to claim 1, wherein the fixed supporting shaft (57) and the movable supporting shaft (60) are placed inside a portion for linkage and connection of the intake rocker arm (31) to the intake valve (20), and a portion of the exhaust valve operating device (33) for swingably supporting the exhaust rocker arm (36) is placed outside a portion for linkage and connection of the exhaust rocker arm (36) and the exhaust valve (21).

3. The engine according to claim 2, wherein a plug cylinder (87) inclined so as to be brought closer to the exhaust valve operating device (33) at a position closer to an upper end thereof is mounted in the cylinder head (14) by being placed between the intake valve operating device (28) and the exhaust valve operating device (33).

* * * * *